US005643372A

United States Patent [19]

Sainfort et al.

[11] Patent Number: 5,643,372

[45] Date of Patent: Jul. 1, 1997

[54] PROCESS FOR THE DESENSITISATION TO INTERCRYSTALLINE CORROSION OF 2000 AND 6000 SERIES AL ALLOYS AND CORRESPONDING PRODUCTS

[75] Inventors: Pierre Sainfort, Grenoble; Jean Domeyne, Coublevie; Timothy Warner, Saint Martin le Vinoux, all of France

[73] Assignee: Pechiney Rhenalu, Courbevoie, France

[21] Appl. No.: 290,534

[22] Filed: Aug. 15, 1994

[30] Foreign Application Priority Data

Sep. 28, 1993 [FR] France ..... 93 11861

[51] Int. Cl.[6] ..... C22F 1/04

[52] U.S. Cl. ..... 148/699; 148/698; 148/700; 148/701; 148/702; 148/437; 148/438; 148/439; 148/440; 420/528; 420/529; 420/533; 420/534; 420/546

[58] Field of Search ..... 148/698, 699, 148/700, 701, 702, 437, 438, 439, 440; 420/528, 529, 533, 534, 546

[56] References Cited

U.S. PATENT DOCUMENTS

| | | | |
|---|---|---|---|
| 3,198,676 | 8/1965 | Sprowls et al. | 148/701 |
| 3,287,185 | 11/1966 | Vachet et al. | 148/701 |
| 3,305,410 | 2/1967 | Sublett et al. | 148/701 |
| 3,988,180 | 10/1976 | Bouvaist | 148/701 |

FOREIGN PATENT DOCUMENTS

| | | |
|---|---|---|
| 1463418 | 3/1965 | France . |
| 2293497 | 7/1976 | France . |
| 2370105 | 6/1978 | France . |
| 1306206 | 2/1973 | United Kingdom . |
| 1552151 | 9/1979 | United Kingdom . |

*Primary Examiner*—David A. Simmons
*Assistant Examiner*—Robert R. Koehler
*Attorney, Agent, or Firm*—Dennison, Meserole, Pollack & Scheiner

[57] ABSTRACT

An improvement to a process for treating an aluminum alloy for the series AA 2000 or AA 6000 comprising solution heat treating, quenching and natural or artificial aging, in which conventional heat solution heat treating is defined as solution heat treating the alloy at a temperature which is 5° to 10° C. below a known eutectics melting temperature for the alloy. The improvement comprises solution heat treating at a temperature which is 10° to 100° C. below the conventional solution heat treating temperature in order to desensitize the alloy to intercrystalline corrosion.

13 Claims, 4 Drawing Sheets

100 μm

100 μm

PROCESS FOR THE DESENSITISATION TO INTERCRYSTALLINE CORROSION OF 2000 AND 6000 SERIES AL ALLOYS AND CORRESPONDING PRODUCTS

BACKGROUND OF THE INVENTION

The present invention relates to a process for the desensitisation to intercrystalline corrosion (IC) of aluminium alloys belonging to the 2000 and 6000 series of the Aluminium Association nomenclature and the corresponding products.

In the scope of this patent application, the 2000 (or 6000) alloys concerned contain Cu or Cu+Mg respectively (or Si+Mg or Si+Mg+Cu) as main elements, possible minor elements such as Mn, Cr, Zr, Zn, Ag and the inevitable impurities from preparation such as Fe up to 1% and Si up to 1% (only in the 2000 alloys in the latter case), the other elements, including Li, having a maximum content of 0.05% each and 0.15% in total. (Unless otherwise mentioned, the compositions refer to the content by weight.)

It is known that for the final use, the alloys concerned are subjected to solution heat treatment, quenched, optionally work-hardened by controlled deformation and aged and/or artificially aged. In this state, these alloys are sensitive to intercrystalline corrosion and this limits their use in corrosive conditions, in particular in a marine atmosphere for prolonged exposure.

It is known that the 6000 series alloys, in particular those containing Cu and notably above Cu=0.3%, are sensitive to IC, but that they are not sensitive to stress corrosion. Under certain conditions, the 2000 series alloys may be sensitive to IC without being sensitive to stress corrosion. This is harmful, not only with regard to the surface appearance but also because the defects induced by IC can trigger the propagation of fatigue cracks, even in the absence of stress corrosion.

It is therefore desirable to improve the resistance to IC of these alloys.

SUMMARY OF THE INVENTION

The process according to the invention involves carrying out solution heat treatment during the thermal treatment of these alloys in a temperature range which is 10° to 100° C. below the conventional solution heat treatment temperature (Shtt).

This temperature range is preferably kept at 10° to 30° C. below Shtt for the 2000 series alloys used in T3xx, T4, T8 or T8xx temper.

It is kept at 10° to 100° C. below Shtt for the 6000 series alloys, in particular for the 6013 or 6056 alloys used in T6, T6xx temper or under-aged or delivered in T3xx or T4 temper.

The aforementioned T tempers, comply with the Aluminium Association nomenclature.

The solution heat treatment temperature Shtt is known to the skilled man.

In practice, conventional solution heat treatment is carried out at a temperature which is 5° to 10° C. below the melting temperature of the eutectics. It is generally mentioned in reference works such as:

Metal Handbook—8th Edition, Vol. 2, 1964, p. 272 Aluminium, Vol. III, Fabrication and Finishing, K. R. Van HORN Ed. ASM, 1967.

However, it may be determined experimentally by metallographic analysis of samples subjected to solution heat treatment at various temperatures and vigorously quenched or by differential enthalpic analysis or DEA; this solution heat treatment temperature generally corresponds to the obtaining of a solid solution which is most saturated in hardening elements and is compatible with the chemical composition of the alloy under consideration and the practical constraints of industrial heat treatments.

The applicant company has noted that the products desensitised to IC could be characterised by two physical parameters taken individually or in combination. These are the superficial electrical conductivity and the DEA signal. The superficial electrical conductivity of the alloys according to the invention is at least 0.7 MS/m higher than that of the alloys according to the prior art treated under similar conditions, except with regard to the solution heat treatment temperature.

The energy associated with the DEA peak relative to the melting of the eutectics of the alloys according to the invention, determined under the conditions mentioned below, is at least 3 J/g higher (as an absolute value) than that relating to the corresponding peak of conventional alloys. DEA thermograms are plotted at a heating rate of 20° C./min on samples of about 50 mg (PERKIN ELMER DSC7 apparatus).

DESCRIPTION OF THE PREFERRED EMBODIMENTS

EXAMPLE 1

Figure 1:
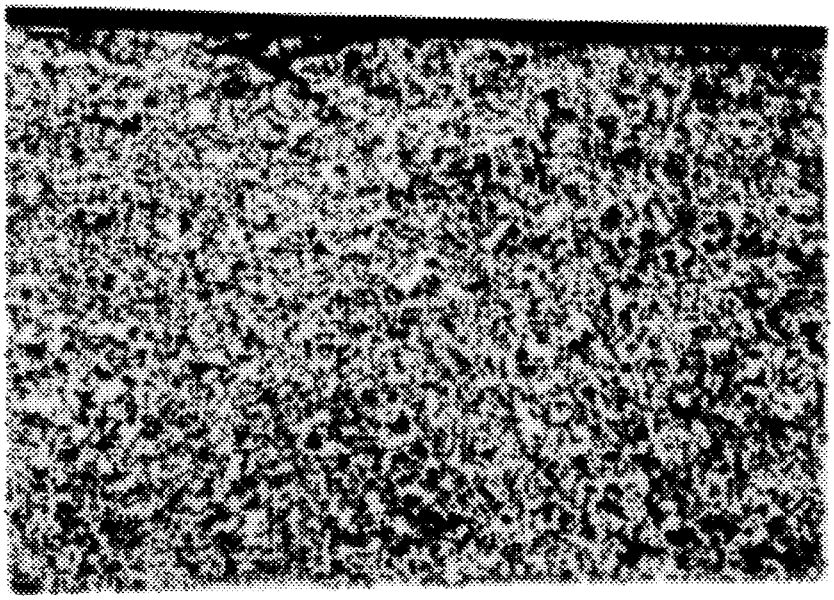
FIG. 1 is a micrographic section taken perpendicular to the longitudinal direction showing the corrosion behavior of a sheet of AA 6013 alloy treated according to the invention as 200× magnification.
Figure 2:
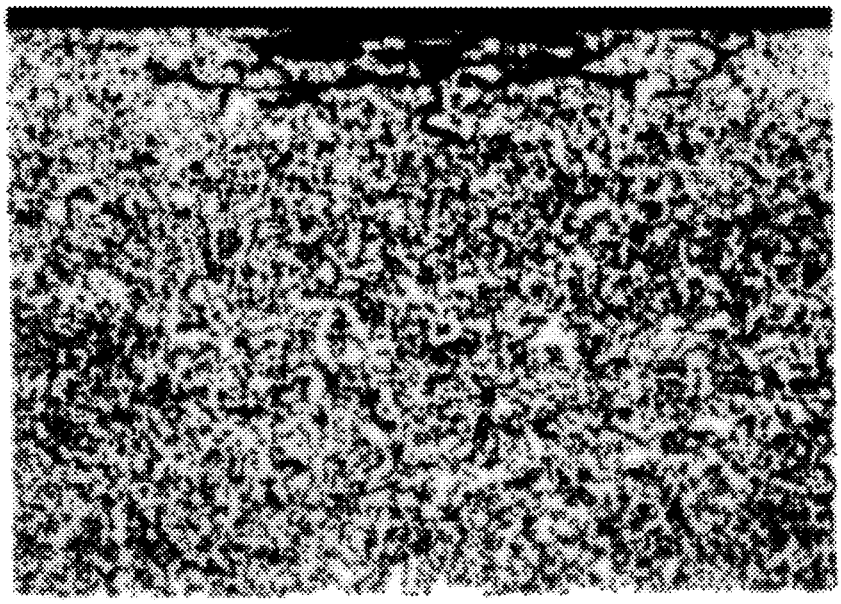
FIG. 2 is a micrographic section taken perpendicular to the longitudinal direction showing corrosion behavior of a sheet of a AA 6013 alloy treated according to the prior art at 200× magnification.
Figure 3:
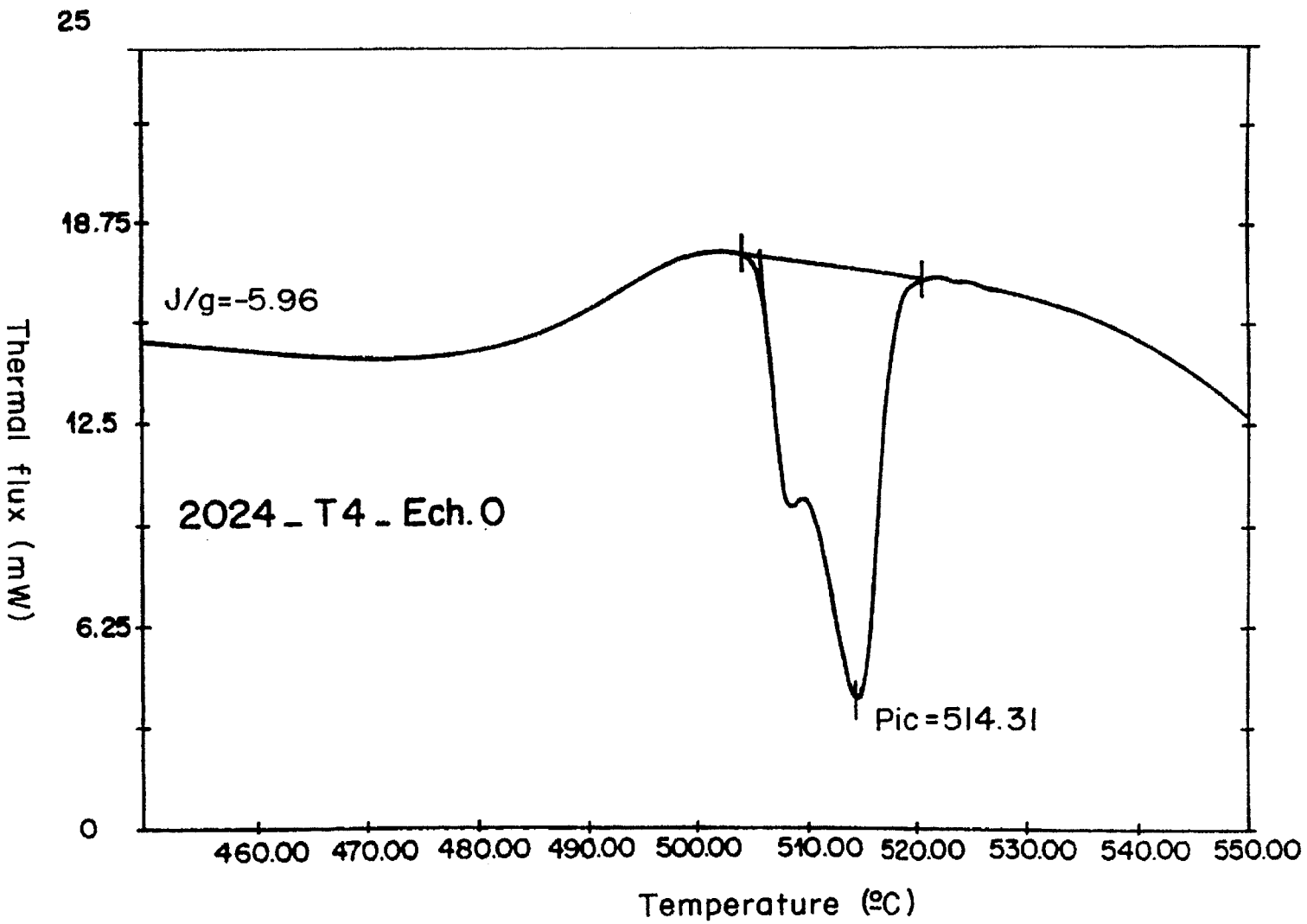
FIG. 3 is a DEA thermogram of prior art sample 0 from Example 1.
Figure 4:
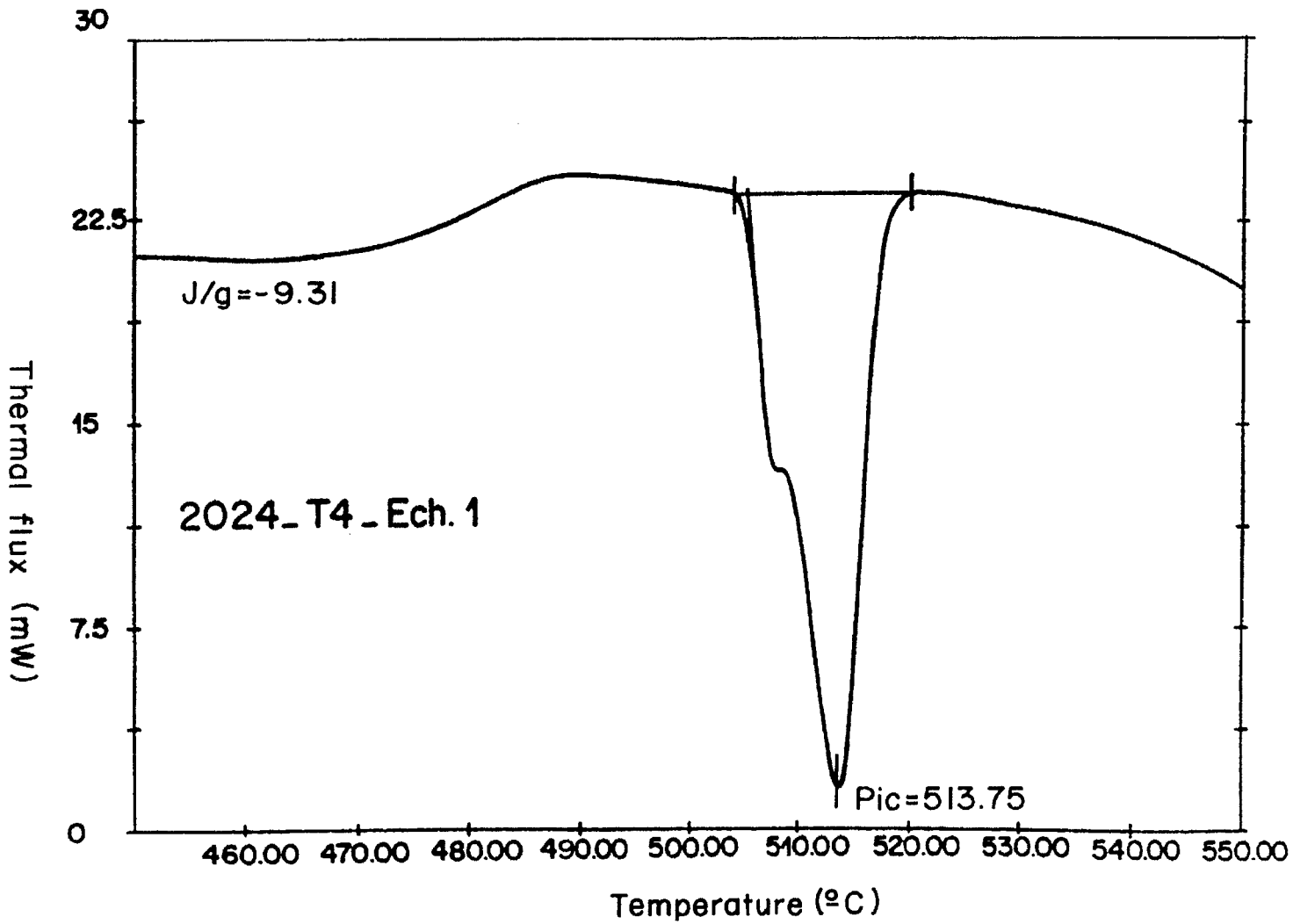
FIG. 4 is a DEA thermogram of sample 1 according to the invention from Example 1.
Figure 5:
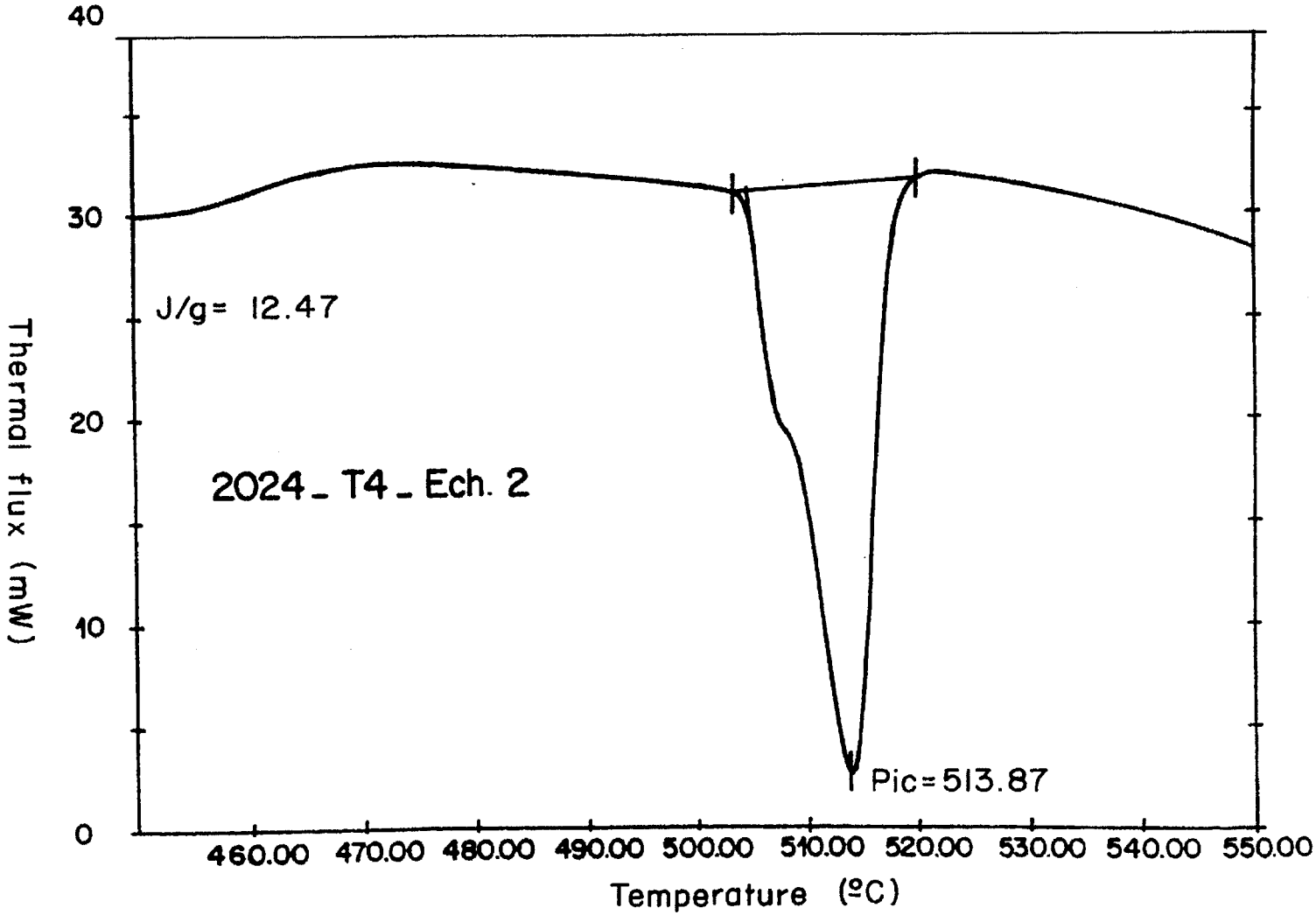
FIG. 5 is a DEA thermogram of sample 2 according to the invention from Example 1.

A sheet of 2024 having dimensions of 2000×1000×26 mm in crude hot-rolled thickness, obtained from a plate cast and homogenized under normal conditions and having the following chemical composition: 0.107% Si; 0.198% Fe; 4.39% Cu; 0.645% Mn; 1.39% Mg; 0.014% Ti; 0.01% Zr; remainder Al, was subjected to solution heat treatment under the following conditions: 1 h at 495, 480 and 470° C. before quenching in cold water and was aged for more than 48 h at ambient temperature. The first temperature (495° C.) corresponds to the conventional solution heat treatment of the alloy.

The mechanical characteristics in the transverse-longitudinal (TL) direction, the resistance to intercrystalline corrosion under the conditions of AIR standard 9048, as well as the resistance to stress corrosion by immersion-emersion (10/50 min) according to ASTM standard G47 under 300 MPa (TL direction) as well as the apparent toughness Kq in the L-T direction (stress in the longitudinal direction and propagation in the TL direction) were determined on this sheet.

The results obtained are given in Table I. It is found that treatments 1 and 2 according to the invention considerably improve the resistance to IC both with regard to the attack behaviour (passage from an intercrystalline attack with blowholes and intercrystalline branching to an attack with blowholes without branching) and the depth of the blowholes (in μm).

Furthermore, the characteristics of mechanical strength and toughness are only very slightly affected (for the treatment at 480° C. for example, R0.2 drops only 3.5%, Kq drops by 3.6%). It can also be seen that the resistance to stress corrosion (SC) is also greatly improved.

EXAMPLE 2

A sheet measuring 2000×1000 mm of 6013 alloy having the following composition by weight: 0.82% Si; 0.22% Fe; 0.92% Cu; 0.9% Mg; 0.62% Mn; 0.15% Zn; ≦0.08% Ti and a thickness of 6 mm was subjected to solution heat treatment under the conditions set out in Table II, the operation being followed by quenching in cold water, precipitation hardening for two days and artificial ageing of the T6 type (6 hours at 175° C.). A comparison is made with a conventional solution heat treatment (30 minutes at 550° C.), followed by quenching in cold water, precipitation hardening for two days and artificial ageing of type T6 (6 hours at 175° C.).

The properties obtained in the two cases are set out in Table II. After an intercrystalline corrosion test, characterisations were made by optical microscopy; the types of corrosion observed (intercrystalline, blowholes (transgranular), or blowholes with intercrystalline branching) as well as the maximum depths of attack (in μm) and the proportions of the surface attacked estimated from micrographic sections are also set out.

The intercrystalline corrosion test used is the internal "Interano" test which involves an electrolytic attack on the sample for 6 hours under a current of 1 ma/cm$^2$ in an electrolytic solution containing 2M $NaCl0_4$0.1 /3M $AlCl_3$ and 0.01M $CrO_4(NH_4)_2$, at ambient temperature.

It can be seen that the alloys treated according to the invention have resistance to intercrystalline corrosion which is substantially better than that of those obtained according to the prior art.

The alloys obtained according to the invention may be used, in particular, in the sphere of the mechanical engineering and transport industries (railway, automobile, aeronautical, maritime industries).

TABLE I

ALLOY 2024

1. Mechanical tensile and toughness characteristics

| Item | Solution Heat Treatment | Direction | R 0.2 MPa | Rm MPa | A % | $K_q$ (Direction L-T) MPa m |
|---|---|---|---|---|---|---|
| 0 | 1 h 495° C. | TL | 345 | 489 | 17.1 | 35.3 (36.8–33.8) |
| 1 | 1 h 480° C. | TL | 333 | 468 | 15.9 | 34 (34.5–33.5) |
| 2 | 1 h 470° C | TL | 309 | 439 | 14 | 30.7 (30.6–30.8) |

2. Resistance to intercrystalline corrosion

| Item | Sample No. 1 I.C., (IL-TC) Core | surface Depth of Attack | Sample No. 2 I.C. (IL-TC) Core | surface Depth of Attack |
|---|---|---|---|---|
| 0 | 150 branching | 100 intercrystalline | 150 branching | 150 intercrystalline |
| 1 | 100 blowholes | 75 blowholes | 75 blowholes | 125 branching |
| 2 | 50/75 blowholes | 59/75 blowholes | 75 blowholes | 100 blowholes |

TABLE I-continued

ALLOY 2024

3. Resistance to corrosion under stress, superficial electrical conductivity and specific energy

| Item | SC (Direction TL) Stress MPa | Service Life Days | C (MS/in) | E (J/g) |
|---|---|---|---|---|
| 0 | 300 | 12, 23, 26 | 17.4 | 5.96 |
| 1 | 300 | 3NR33/3 | 18.3 | 9.31 |
| 2 | 300 | 3NR33/3 | 19.3 | 12.47 |

*in μm.

TABLE II

ALLOY 6013

1. Corrosion (Type of attack, depth in μm and proportion of the surface attacked)

| (T6) - at surface Residence Time (t) | Temperature (T) 450° C. | 500° C. | 550° C. |
|---|---|---|---|
| 30 minutes | Trans + Inter 100 μm, branching (a) | Inter 150 μm, 100% | Inter 200 μm, 100% (b) |
| 2 hours | Trans + Inter 150 μm, 755 | Inter 200 μm, 100% | — |

2. Physical Properties (state T6)

| Solution Heat Treatment | Conductivity (MS/m) | Energy (J/g) |
|---|---|---|
| 550° C. - 30 min | 23,0 | ≦1 |
| 450° C. - 30 min | 27,0 | 7,5 |

What is claimed is:

1. In a process for treating an aluminum alloy of the series AA 2000 or AA 6000 comprising solution heat treating, quenching and natural or artificial aging, wherein conventional solution heat treating is defined as solution heat treating the alloy at a temperature which is 5° to 10° C. below a known eutectics melting temperature for the alloy, the improvement comprising solution heat treating the alloy at a temperature which is 5° to 110° C. below said conventional solution heat treating temperature in order to desensitize the alloy to intercrystalline corrosion.

2. Process according to claim 1, wherein the alloy is of the AA 2000 series in a T3, T3xx, T4, T8 or T8xx temper, and the temperature of said solution heat treating is 5° to 40° C. less than said eutectics melting temperature.

3. Process according to claim 2, wherein the alloy is a sheet of AA 2024 alloy, and the solution heat treating takes place at 470°–480° C.

4. Process according to claim 1, wherein the alloy is of the AA 6000 series in a T6 or T6xx temper.

5. Process according to claim 4, wherein the alloy is a sheet of AA 6013 alloy, and the solution heat treating takes place at 450°–500° C.

6. An aluminum alloy of the AA 2000 series in T3, T3xx, T4, T8, or T8xx temper, or AA 6000 series in T6 or T6xx temper, treated by solution heat treating at a temperature which is 15° to 110° C. below a known eutectics melting temperature for the alloy, quenching a natural or artificial aging, and which is resistant to intercrystalline corrosion, said alloy having a surface conductivity at least 0.7 MS/m higher than said alloy subjected to a conventional solution heat treating, wherein a conventional solution heat treating is defined as solution heat treating at a temperature 5° to 10° C. below said known eutectics melting temperature for the alloy.

7. An aluminum alloy according to claim 6, of the AA 6000 series and containing more than 0.3 wt % Cu.

8. An aluminum alloy according to claim 6, which is an AA 2024 alloy.

9. An aluminum alloy according to claim 6, which is an AA 6013 alloy or AA 6056 alloy.

10. An aluminum alloy of the AA 2000 series in the T3, T3xx, T4, T8 or T8xx temper, or the AA 6000 series in the T6, T6xx, under-aged, T3xx or T4 temper, treated by solution heat treating at a temperature which is 15° to 110° C. below a known eutectics melting temperature for the alloy, quenching and natural or artificial aging, and which is resistant to intercrystalline corrosion, said alloy having an energy associated with the melting peak of the eutectics determined by DEA thermogram at least 3 J/g higher in absolute value than said alloy subjected to a conventional solution heat treating, wherein a conventional solution heat treating is defined as solution heat treating at a temperature 5° to 10° C. below said known eutectics melting temperature for the alloy.

11. An aluminum alloy according to claim 10, of the AA 6000 series and containing more than 0.3 wt % Cu.

12. An aluminum alloy according to claim 10, which is an AA 2024 alloy.

13. An aluminum alloy according to claim 10, which is an AA 6013 alloy or AA 6056 alloy.

* * * * *